US011560815B1

(12) United States Patent
McCloy

(10) Patent No.: US 11,560,815 B1
(45) Date of Patent: Jan. 24, 2023

(54) COMPLIANT COUPLING FOR ELECTRICALLY-CONTROLLED VARIABLE CAMSHAFT TIMING ASSEMBLY

(71) Applicant: BorgWarner Inc., Auburn Hills, MI (US)

(72) Inventor: Chad M. McCloy, Cortland, NY (US)

(73) Assignee: BORGWARNER INC., Auburn Hills, MI (US)

( * ) Notice: Subject to any disclaimer, the term of this patent is extended or adjusted under 35 U.S.C. 154(b) by 0 days.

(21) Appl. No.: 17/830,963

(22) Filed: Jun. 2, 2022

(51) Int. Cl.

| | |
|---|---|
| ***F01L 1/352*** | (2006.01) |
| ***F01L 9/22*** | (2021.01) |
| ***F01L 1/344*** | (2006.01) |
| ***F01L 1/46*** | (2006.01) |
| *F01L 13/00* | (2006.01) |

(52) U.S. Cl.
CPC ..... *F01L 1/352* (2013.01); *F01L 1/344* (2013.01); *F01L 1/46* (2013.01); *F01L 9/22* (2021.01); *F01L 2013/103* (2013.01); *F01L 2800/12* (2013.01); *F01L 2820/032* (2013.01)

(58) Field of Classification Search
CPC ..... F01L 1/352; F01L 1/46; F01L 2013/103; F01L 2800/12; F01L 2820/032
USPC ..... 123/90.15
See application file for complete search history.

(56) References Cited

U.S. PATENT DOCUMENTS

| | | | | |
|---|---|---|---|---|
| 6,948,464 | B2 | 9/2005 | Ido et al. | |
| 2009/0120388 | A1 | 5/2009 | Lee et al. | |
| 2013/0312682 | A1 | 11/2013 | Schaefer et al. | |
| 2017/0198755 | A1 * | 7/2017 | Brown | F16D 3/10 |

FOREIGN PATENT DOCUMENTS

| | | | |
|---|---|---|---|
| DE | 102017008953 | A1 * | 3/2019 |
| WO | WO2012110131 | A1 | 8/2012 |

* cited by examiner

*Primary Examiner* — Jorge L Leon, Jr.
(74) *Attorney, Agent, or Firm* — Reising Ethington P.C.

(57) ABSTRACT

An electrically-controlled variable camshaft timing (VCT) system including a sun gear, having an inner axial surface, configured to communicate torque from an output shaft of an electric motor to a gearbox assembly; and a collet sleeve having at least one slot configured to engage the output shaft of the electric motor and a relief section permitting radial-inward compression and an outer axial surface that releasably engages the inner axial surface of the sun gear such that the outer axial surface of the collet sleeve is engaged with the inner axial surface of the sun gear while an amount of torque applied to the sun gear by the output shaft is below a predetermined torque threshold and the sun gear and the collet sleeve are angularly displaced relative to each other when an amount of torque applied to the sun gear by the output shaft is at or above the predetermined torque threshold.

15 Claims, 6 Drawing Sheets

COMPLIANT COUPLING FOR ELECTRICALLY-CONTROLLED VARIABLE CAMSHAFT TIMING ASSEMBLY

TECHNICAL FIELD

The present application relates to variable camshaft timing and, more particularly, to electrically-actuated variable camshaft timing assemblies.

BACKGROUND

Vehicles can include electric motors that carry out a variety of vehicle functions, including, for example, adjusting the angular position of one or more camshafts with respect to the angular position of a crankshaft or adjusting the position of a passenger or driver seat. Electric motors can be used to operate a camshaft phaser to advance or retard the timing of a camshaft with respect to the crankshaft. The camshaft phaser may include a gearbox that is driven by an electric motor. Mechanical stops that limit the range of authority of the camshaft phaser can be included in the gearbox. When the camshaft phaser reaches an end of the range, gearbox movement can be stopped abruptly and a relatively large amount of torque may be applied to the output shaft of the electric motor. This amount of torque may cause unwanted stress to the camshaft phaser and it would be helpful to reduce this stress.

SUMMARY

In one implementation, an electrically-controlled variable camshaft timing (VCT) system including a sun gear. having an inner axial surface, configured to communicate torque from an output shaft of an electric motor to a gearbox assembly; and a collet sleeve, having at least one slot configured to engage the output shaft of the electric motor, a relief section permitting radial-inward compression, and an outer peripheral surface that releasably engages the inner peripheral surface of the sun gear such that the outer axial surface of the collet sleeve engages with the inner axial surface of the sun gear while an amount of torque applied to the sun gear by the output shaft is below a predetermined torque threshold, wherein the sun gear and the collet sleeve are angularly displaced relative to each other when an amount of torque applied to the sun gear by the output shaft is at or above the predetermined torque threshold.

In another implementation, an electrically-controlled VCT system includes a sun gear, having an inner axial surface including at least one depression or at least one protuberance, configured to communicate torque from an output shaft of an electric motor to a gearbox assembly; and a collet sleeve, having the other of the at least one depression or the at least one protuberance, at least one slot configured to engage the output shaft of the electric motor, and a relief section permitting radial-inward compression, wherein the at least one protuberance is deflected radially such that the protuberance is releasably placed into engagement with the depression while an amount of torque applied to the sun gear by the output shaft is below a predetermined torque threshold and moves relative to the at least one depression when an amount of torque applied to the sun gear by the output shaft is at or above the predetermined torque threshold.

DETAILED DESCRIPTION

A compliant coupling assembly can releasably couple an output shaft of an electric motor with a gearbox assembly included in an electrically-controlled variable camshaft timing (VCT) assembly—sometimes referred to as an electrically-controlled camshaft phaser. An example of an electrically-controlled VCT assembly is disclosed in U.S. Application Ser. No. 17/522,304, the contents of which are incorporated by reference. The electrically-controlled VCT assembly can include a gearbox assembly having an input coupled to a shaft of an electric motor and an output coupled to a camshaft of an internal combustion engine. As the electric motor operates and adjusts the gearbox assembly in a way that advances or retards the camshaft with respect to the crankshaft, mechanical stops can limit the amount of angular displacement of the camshaft relative to the crankshaft. When the output shaft of the electric motor adjusts the gearbox such that the mechanical stops are reached or engaged, a significant load can be applied to the gearbox of the phaser. A compliant coupling between the output shaft of the electric motor and the gearbox can minimize the shock from this load.

Figure 2:
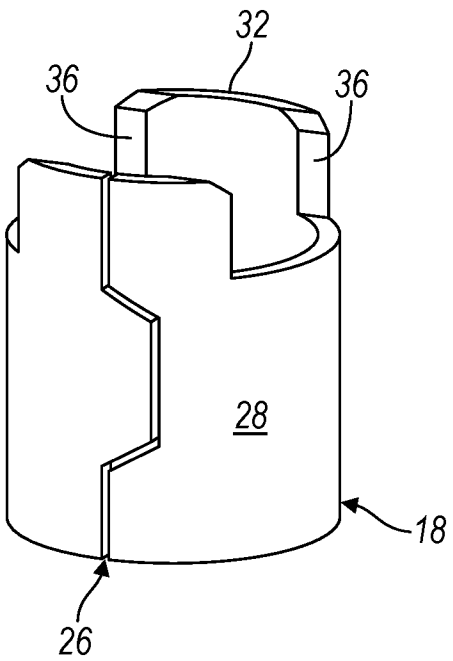
FIG. 2 is a perspective view depicting a portion of an implementation of a compliant coupling assembly.
Figure 1:
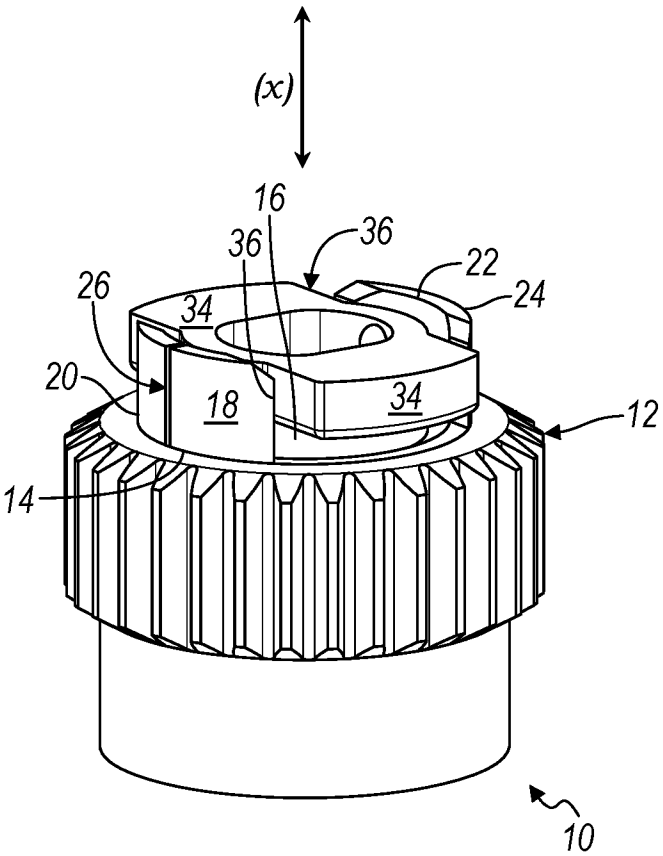
FIG. 1 is a perspective view depicting an implementation of a compliant coupling assembly.

The compliant coupling can include a sun gear and a collet sleeve. In one implementation shown in FIGS. 1-2, a sun gear 10 of a gearbox assembly (not shown) used in an electrically-controlled VCT assembly can include radially-outwardly-extending gear teeth 12 and an inner axial surface 14. The sun gear 10 can communicate rotational movement or torque from an output shaft 16 of the electric motor to the gearbox assembly thereby controlling the angular position of the camshaft relative to the crankshaft. While in this embodiment the sun gear 10 includes radially-outwardly extending gear teeth 12, it should be appreciated that the term "sun gear" should be viewed to broadly include other implementations, such as ones without gear teeth, and the gearbox assembly could be a harmonic drive such that the term "sun gear" could also describe a wave generator that engages a flexspline.

A collet sleeve 18 can be positioned radially-inwardly relative to an inner diameter 20 of the sun gear 10 and transmit rotational motion or torque from the output shaft 16 of the electric motor to the gearbox of the phaser. The collet sleeve 18 can be substantially annular having an inner diameter 22, an outer diameter 24, and a relief section 26 comprising a slot or other area where material has been removed. An outer axial surface 28 of the collet sleeve 18 and/or the inner axial surface 30 of the sun gear 10 can have a defined or elevated coefficient of friction. The elevated coefficient of friction can be created by abrading the outer axial surface 28 or the inner axial surface 30 using any one of a number of techniques, such as laser etching. The collet sleeve 18 can be compressed radially inwardly toward an axis of rotation such that the outer diameter 24 of the collet sleeve 18 is temporarily reduced and the collet sleeve 18 can be concentrically positioned within the inner diameter 20 of the sun gear 10. Once concentrically positioned, the compressive force can be reduced and the outer axial surface 28 of the collet sleeve 18 can move into releasable engagement with the inner axial surface 30 of the sun gear 10. When positioned concentrically to engage the inner axial surface 30 of the sun gear 10, the collet sleeve 18 provides radially-outwardly-directed force toward the sun gear 10. The radially-outwardly-directed force, along with the coefficient of friction of the inner axial surface 30 of the sun gear 10 and/or the outer axial surface 28 of the collet sleeve 18, can prevent the angular displacement of the collet sleeve 18 relative to the sun gear 10.

Figure 5:
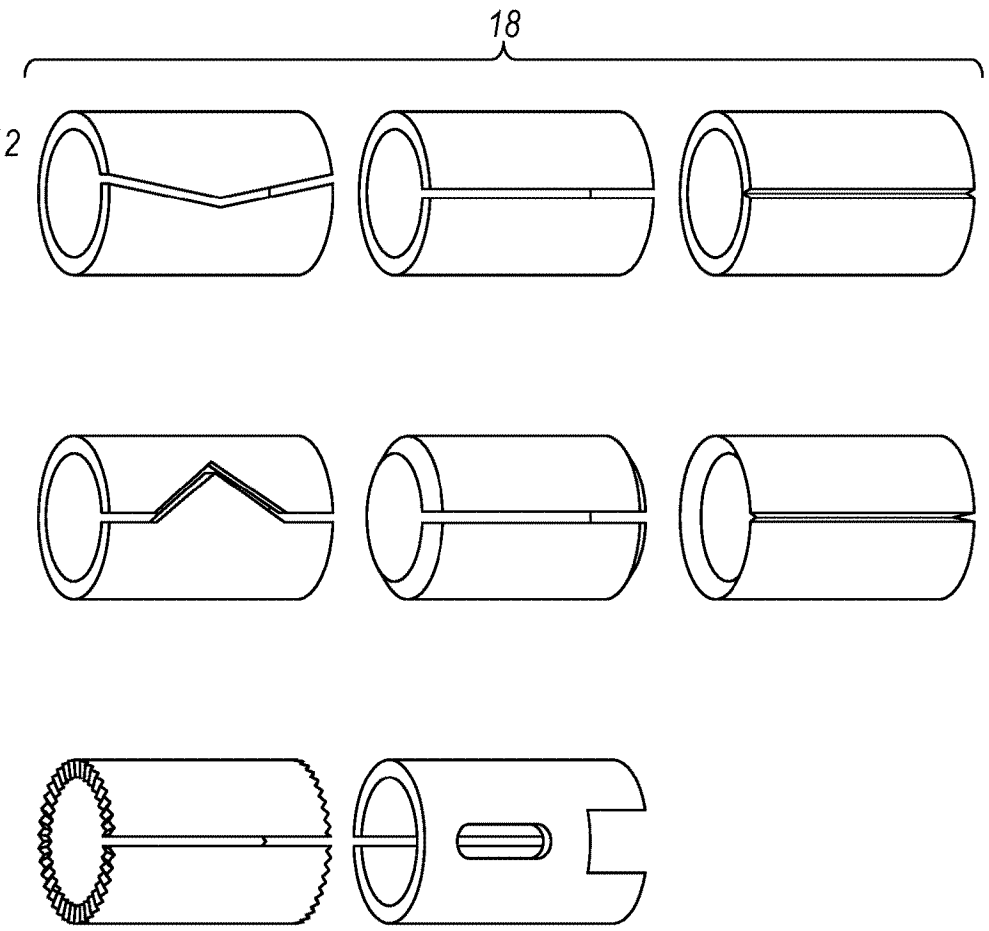
FIG. 5 is another perspective view depicting another implementation of a compliant coupling assembly.
Figure 3:
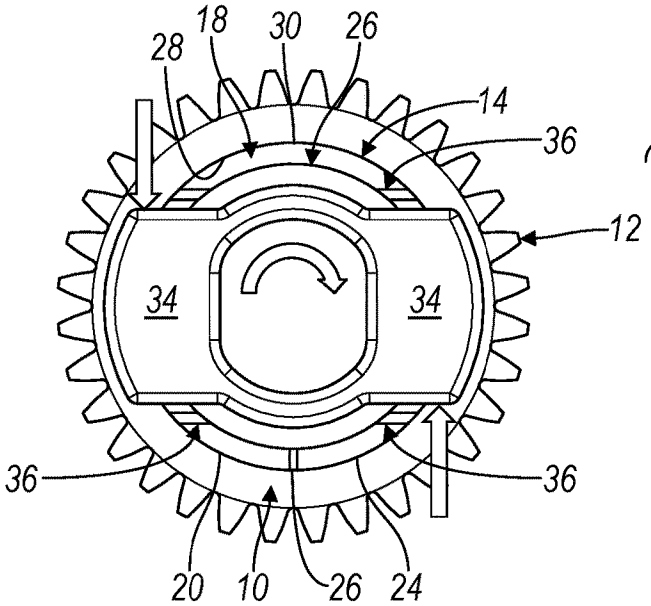
FIG. 3 is another perspective view depicting a portion of an implementation of a compliant coupling assembly.
Figure 4:
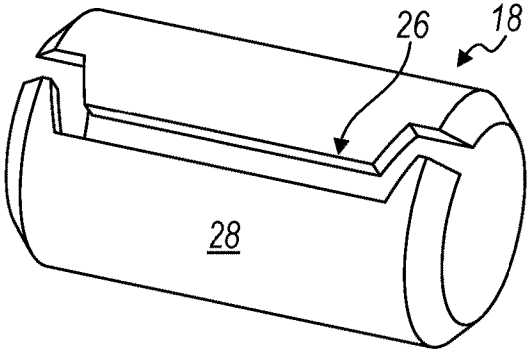
FIG. 4 is another perspective view depicting a portion of an implementation of a compliant coupling assembly.
Figure 7:
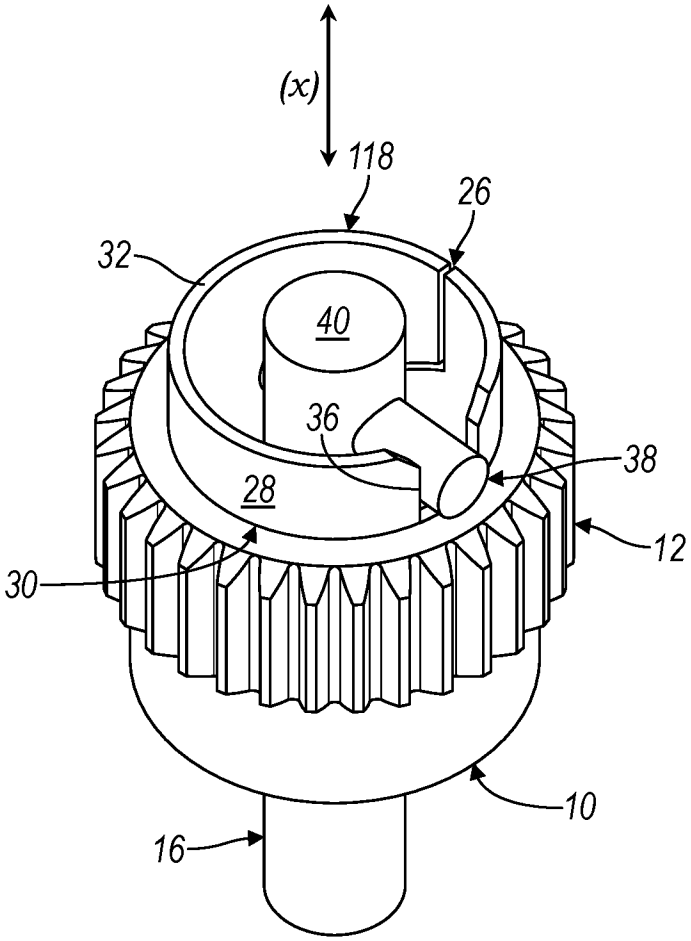
FIG. 7 is another profile view depicting another implementation of a compliant coupling assembly.
Figure 6:
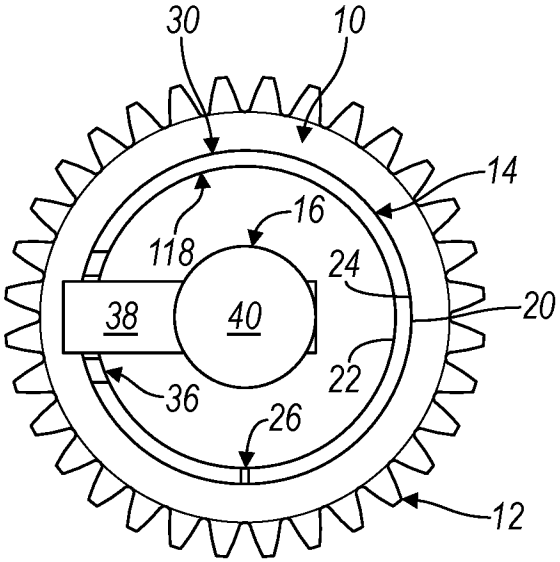
FIG. 6 is a profile view depicting another implementation of a compliant coupling assembly.
Figure 10:
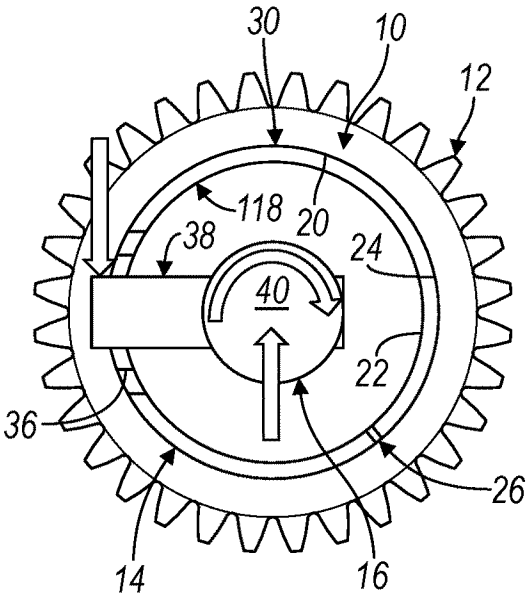
FIG. 10 is a profile view depicting another implementation of a compliant coupling assembly.
Figure 9:
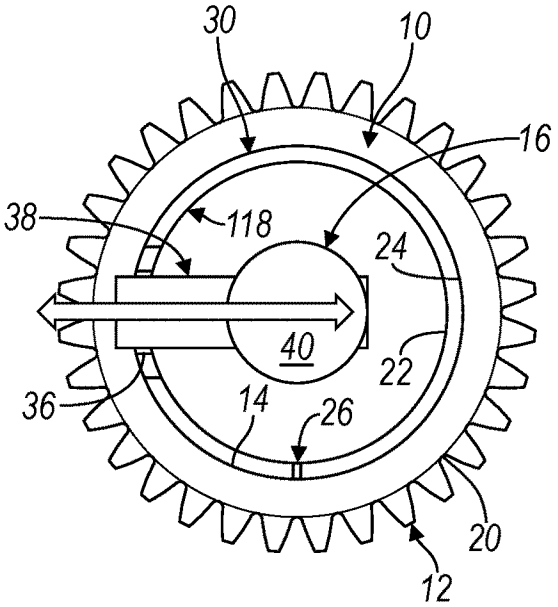
FIG. 9 is a profile view depicting another implementation of a compliant coupling assembly.
Figure 8:
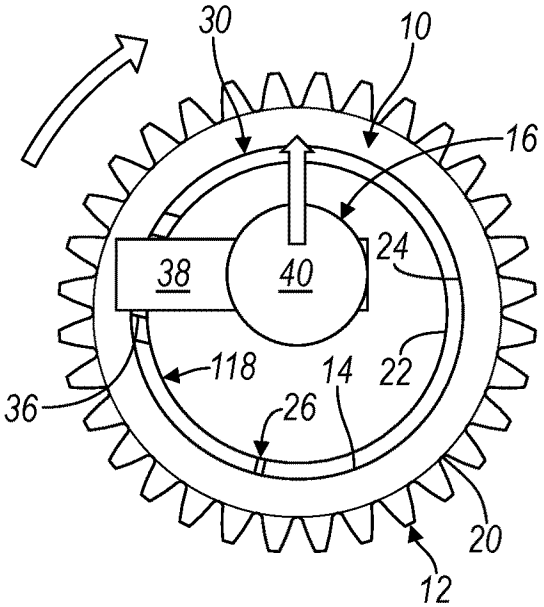
FIG. 8 is another profile view depicting another implementation of a compliant coupling assembly.

The collet sleeve 18 can include one or more slots 36 at an axial end 32 that engage with the output shaft 16 of the electric motor. An implementation of the collet sleeve 18 is shown in FIG. 3 in more detail, which includes two slots 36 spaced apart 180 degrees or $\pi$, radians circumferentially along the axial end 32 of the collet sleeve 18. The slots 36 can be formed by reducing an axial length of material along a circumferential section of the collet sleeve 18. The output shaft 16 of the electric motor can include two radially-outwardly-extending tabs 34 that are shaped to be received by the slots 36 in the collet sleeve 18. The tabs 34 can be formed as part of a key pivotally attached to the output shaft 16. Other implementations of the collet sleeve 18 are shown in FIG. 5. The relief section 26 of the collet sleeve 18 can he shaped in a variety of ways. For example, the relief section 26 can be a V-shaped seam, a straight seam, a variable width seam that has a smaller width at one end, an irregularly shaped relief section, or a closed-end slot. The end of the collet sleeve 18 can be chamfered beginning at the outer diameter 24, chamfered at the inner diameter 22, or can be serrated.

During operation of the electrically-controlled phaser, the output shaft 16 of the electric motor can communicate torque from the tabs 34 through the collet sleeve 18 to the sun gear 10 at or below a predetermined torque value. Once the torque exerted on the gearbox assembly through the output shaft 16 rises above the predetermined torque value, such as when the gearbox assembly reaches the mechanical stops, the collet sleeve 18 can be angularly displaced from the sun gear 10. The relief section 26 can help permit the outer diameter 24 of the collet sleeve 18 to reduce and the angular force exerted on the collet sleeve 18 by the output shaft 16 can overcome the coefficient of friction between the inner axial surface 30 of the sun gear 10 and/or the outer axial surface 28 of the collet sleeve 18.

In another implementation, a collet sleeve 118 shown in FIGS. 6-10 includes a single slot 36 at an axial end 32 of the collet sleeve 118. A post 38 can extend radially-outwardly from one side of a distal end 40 of the output shaft 16 of the electric motor. The post 38 can engage the collet sleeve 118 at one point along the distal end of the collet sleeve 118 through the single slot 36. In this implementation, the output shaft 16 of the electric motor can have additional degrees of deviation from an axis of camshaft rotation (x) or output shaft rotation relative to an implementation of a collet sleeve with a plurality of slots.

Figure 13:
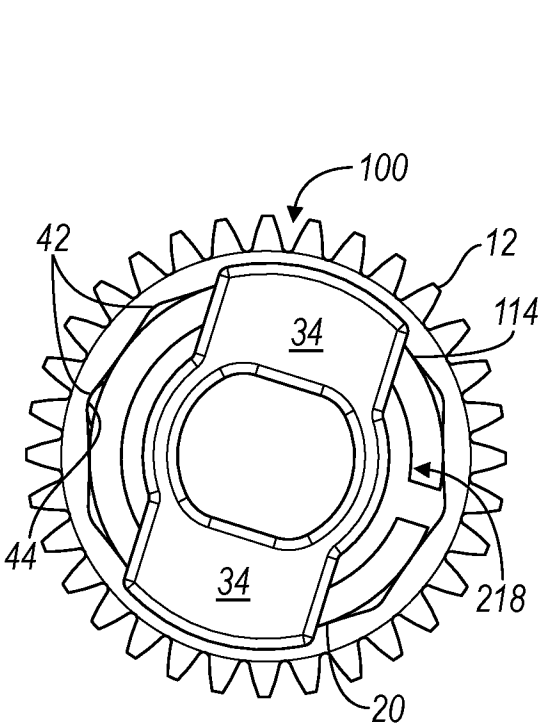
FIG. 13 is a profile view depicting another implementation of a compliant coupling assembly.
Figure 12:
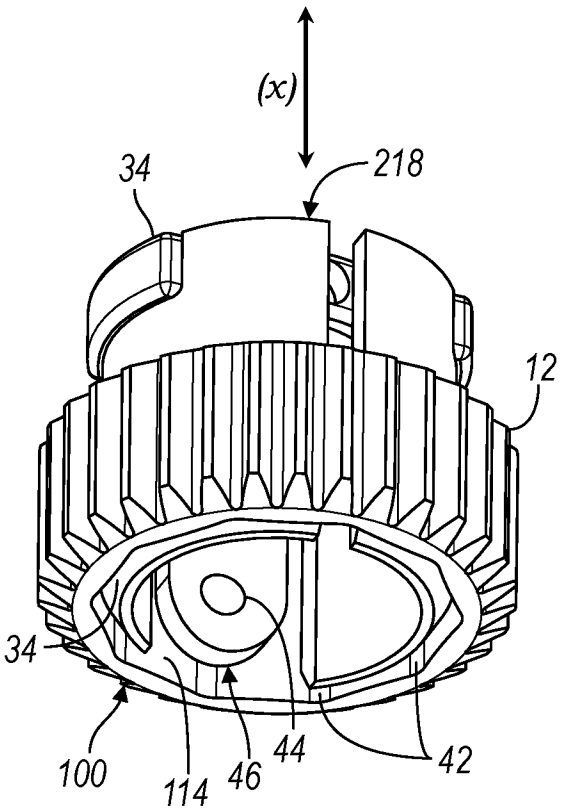
FIG. 12 is another perspective view depicting another implementation of a compliant coupling assembly.
Figure 11:
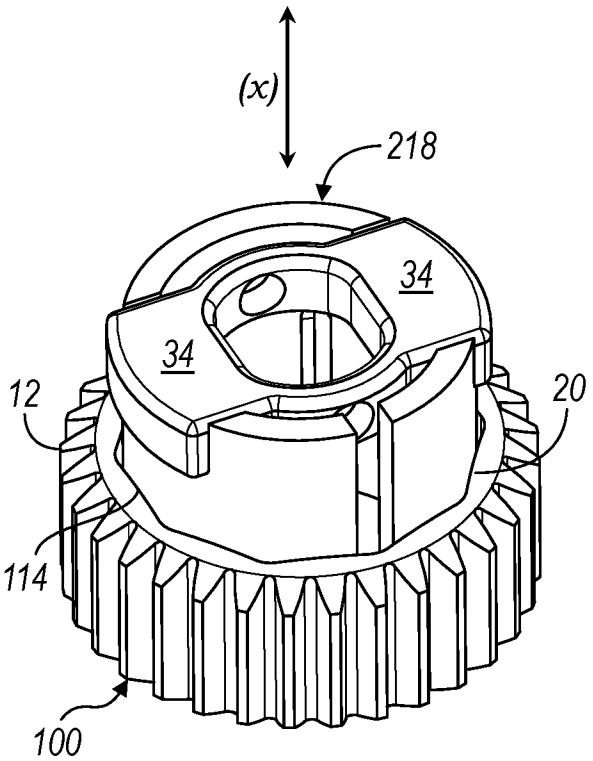
FIG. 11 is another perspective view depicting another implementation of a compliant coupling assembly.
Figure 15:
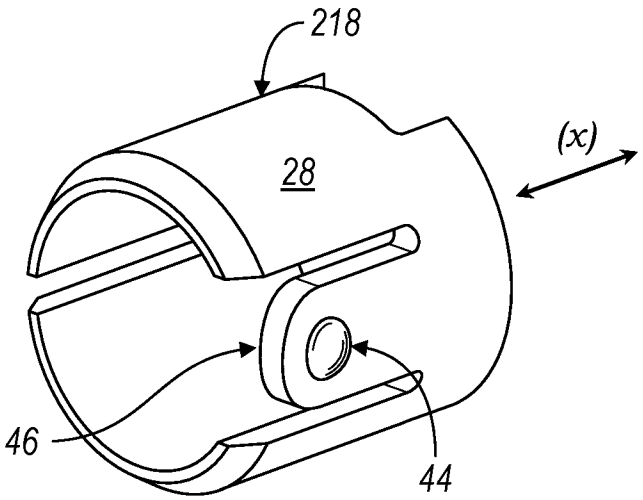
FIG. 15 is a perspective view depicting a portion of an implementation of a compliant coupling assembly.
Figure 14:
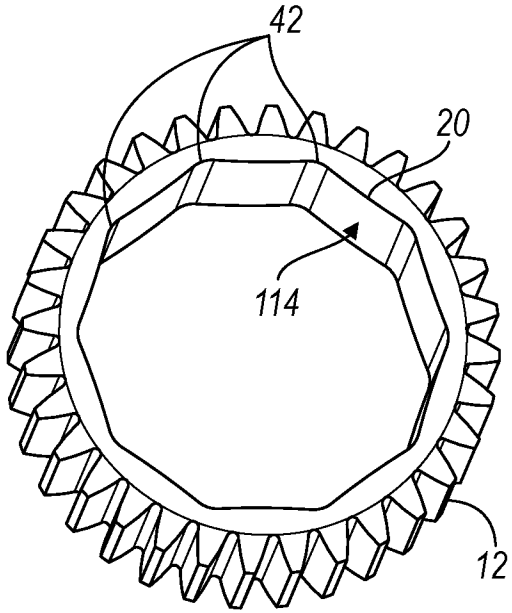
FIG. 14 is a perspective view depicting a portion of an implementation of a compliant coupling assembly.

Turning to FIGS. 11-15, another implementation of a compliant coupling assembly is shown including a sun gear 100 and a collet sleeve 218. The sun gear 100 includes radially-outwardly-extending gear teeth 12 and an inner axial surface 114 having one or more depressions 42 shaped to releasably receive or hold corresponding radially-outwardly-extending protuberances 44 positioned on the outer axial surface 28 of the collet sleeve 218. An implementation of the compliant coupling assembly including the sun gear 100, the collet sleeve 218, and radially-outwardly-extending tabs 34 is shown in FIGS. 11-13 while FIG. 14 depicts the sun gear 100 and FIG. 15 depicts the collet sleeve 218. The inner axial surface 114 of the sun gear 100 can include one or more depressions 42 that can be formed in different ways. For example, the inner diameter 20 of the sun gear 100 can vary thereby creating depressions 42 that are shaped to releasably hold a corresponding protuberance 44. The protuberance 44 can be a truncated sphere extending radially outwardly away from an outer axial surface 28 of the collet sleeve 218. In this implementation, the collet sleeve 218 can include a tang 46, on which the protuberance 44 is included on the outer axial surface 28, that can be moved radially inwardly toward an axis of rotation (x) when the sleeve 218 engages the sun gear 100. The inward movement or deflection of the tang 46 caused by the inner axial surface 114 can create a radially-outwardly directed force exerted by the protuberance 44 on the depression 42. The size and shape of the depressions 42 and the protuberances 44 as well as the thickness of the tang 46 can be selected to create a desired predetermined torque limit at which the sun gear 100 can be angularly displaced from the collet sleeve 218. It should also be appreciated that other designs are possible in which the inner axial surface of the sun gear could have protuberances and the outer axial surface of the collet sleeve could have depressions.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items.

Other terms are to be construed using their broadest reasonable meaning unless they are used in a context that requires a different interpretation.

What is claimed is:

1. An electrically-controlled variable camshaft timing (VCT) system, comprising:

a sun gear, configured to communicate torque from an output shaft of an electric motor to a gearbox assembly, the sun gear including an inner surface; and a collet sleeve including;

at least one slot; configured to engage the output shaft, a relief section configured to enable a radial-inward compression of the collet sleeve, and an outer surface configured to releasably engage the inner surface of the sun gear, wherein the outer surface of the collet sleeve engages the inner surface of the sun gear so as to rotationally couple the sun gear to the collet sleeve while an amount of torque applied to the sun gear by the output shaft is less than a predetermined torque threshold, and wherein the sun gear is rotationally decoupled from the collet sleeve when the amount of torque applied to the sun gear by the output shaft is greater than or equal to the predetermined torque threshold.

2. The electrically-controlled VCT system recited in claim 1, wherein a coefficient of friction of the inner surface of the sun gear is greater than a coefficient of friction of the outer surface of the collet sleeve.

3. The electrically-controlled VCT system recited in claim 1, wherein the sun gear further includes radially-outwardly extending gear teeth.

4. The electrically-controlled VCT system recited in claim 1, wherein the relief section is a non-linear relief section.

5. The electrically controlled VCT system recited in claim 1, wherein the relief section is a V-shaped seam.

6. The electrically-controlled VCT system recited in claim 1. wherein the relief section is a V-shaped seam, a straight seam, a variable width seam that has a smallest width at an axial end of the collet sleeve, an irregularly shaped relief section, or a closed-end slot.

7. The electrically-controlled VCT system recited in claim 1, wherein an axial end of the collet sleeve is chamfered.

8. The electrically-controlled VCT system recited in claim 1, wherein an axial end of the collet sleeve is serrated.

9. The electrically-controlled VCT system recited in claim 1, wherein the at least one slot is arranged at an axial end of the collet sleeve.

10. The electrically-controlled VCT system recited in claim 1, wherein the at least one slot includes a plurality of slots.

11. The electrically-controlled VCT system recited in claim 10, wherein a coefficient of friction of the inner surface of the sun gear is greater than a coefficient of friction of the outer surface of the collet sleeve.

12. An electrically-controlled variable camshaft timing (VCT) system, comprising:

a sun gear configured to communicate torque from an output shaft of an electric motor to a gearbox assembly, the sun gear including at least one depression or at least one protuberance; and a collet sleeve including;

at least one slot configured to engage the output shaft, a relief section configured to enable a radial-inward compression of the collet sleeve, and a remaining one of the at least one depression or the at least one protuberance.

wherein the at least one protuberance is deflected radially such that the at least one protuberance releasably engages the at least one depression so as to rotationally couple the sun gear to the collet sleeve while an amount of torque applied to the sun gear by the output shaft is less than a predetermined torque threshold, and wherein the at least one protuberance moves relative to the at least one depression so as to rotationally decouple the sun gear from the collet sleeve when the amount of torque applied to the sun gear by the output shaft is greater than or equal to the predetermined torque threshold.

13. The electrically-controlled VCT system recited in claim 12. wherein the sun gear further includes radially-outwardly extending gear teeth.

14. The electrically-controlled VCT system recited in claim 12. wherein the relief section is a non-linear relief section.

15. The electrically-controlled VCT system recited in claim 12. wherein the collet sleeve further includes a tang on which the at least one protuberance or the at least one depression is formed.

* * * * *